United States Patent [19]

Biggar, III

[11] 4,085,674

[45] Apr. 25, 1978

[54] REGISTRATION UNIT FOR PRINTING OR COLLATING APPARATUS

[75] Inventor: Frank M. Biggar, III, Angola, N.Y.

[73] Assignee: Frank M. Biggar, Jr., Hamburg, N.Y.

[21] Appl. No.: 710,143

[22] Filed: Jul. 30, 1976

[51] Int. Cl.[2] ..... B41F 13/14

[52] U.S. Cl. ..... 101/248; 101/181; 101/226; 83/343

[58] Field of Search ..... 101/248, 181, 226, 227, 101/224; 74/395; 83/298, 301, 497, 343; 270/1, 4, 5

[56] References Cited

U.S. PATENT DOCUMENTS

| | | | |
|---|---|---|---|
| 1,305,891 | 6/1919 | Flick | 101/248 |
| 1,951,536 | 3/1934 | Swift, Jr. | 74/395 |
| 2,030,027 | 2/1936 | Greenwood | 74/395 |
| 2,030,028 | 2/1936 | Greenwood | 74/395 |
| 2,141,101 | 12/1938 | Webster | 74/395 |
| 2,174,728 | 10/1939 | Potdevin | 101/248 |
| 3,026,798 | 3/1962 | Frostad | 101/248 |
| 3,762,698 | 10/1973 | Thomas | 270/20 |

FOREIGN PATENT DOCUMENTS

| | | | |
|---|---|---|---|
| 1,056,677 | 3/1955 | France | 101/248 |
| 2,160,416 | 6/1973 | Germany | 101/248 |
| 594,261 | 11/1947 | United Kingdom | 101/248 |

*Primary Examiner*—J. Reed Fisher
*Attorney, Agent, or Firm*—Rogers, Eilers & Howell

[57] ABSTRACT

In an apparatus such as a printing press or collator for performing operations such as printing, perforating, punching, die cutting, and the like on a continuous paper web, a registration unit for changing the phase of a first shaft relative to a second shaft where said shafts are rotatably mounted between parallel frame members of the apparatus, the registration unit having a sleeve rotatably mounted about the second shaft with a concentric output gear mounted thereto and rotatable therewith. An output drive gear is mounted to the sleeve and concentric with the output gear for rotation therewith, said output gear providing the output drive for rotatably driving said first shaft. A motor drive and gear assembly is mounted to said second shaft outboard of said frame for rotation therewith and is in engagement with said output drive gear for selectively rotating said output drive gear relative to said second shaft, whereby rotation of said output drive gear relative to said second shaft produces rotation of said sleeve, output gear, and first shaft relative to said second shaft. In one aspect of the invention said sleeve is rotatably mounted about said second shaft outboard of the frame members and said output gear is also outboard of said frame members. In another aspect of the invention, said sleeve extends through one of said frame members, and said output gear is located inboard of said frame members.

19 Claims, 8 Drawing Figures

REGISTRATION UNIT FOR PRINTING OR COLLATING APPARATUS

BACKGROUND AND SUMMARY OF THE INVENTION

This invention generally relates to registration units for use in apparatus such as printing presses or collators for performing operations such as printing, perforating, punching, die cutting, and the like on a continuous paper web. Specifically, it relates to such units for registering the phase or angular displacement of one roller relative to another used in performing particular operations on the web. In the print operation these rollers or cylinders are the plate and impression cylinders. In the die cutting operation they are the die and anvil cylinders. In the punching operation they are the male and female punch cylinders and the associated drive shaft. And in the perforating operation they are the perforator and anvil cylinders. The importance of proper registration is well recognized in the art, but generally it is to insure that each operation is performed on the traveling paper web at precisely the proper time in relation to the other operations.

Registration units of this general type are known in the art. For example, U.S. Pat. No. 3,762,698 issued Oct. 2, 1973, and assigned to the same assignee as the present application, discloses a registration unit of which the present unit is an improvement. The drive connection or registration unit of the referenced patent is specifically for phase registration of a fanfolding machine with the traveling web and includes an electric motor and worm drive mounted on a shaft inboard of the folder frame, said shaft extending through the frame and having an output gear mounted thereto on the outboard side of the frame. Power is transmitted from the shaft to the output gear through the motor driven gear assembly, and actuation of the motor causes angular displacement of the output gear relative to the shaft and in this way precise registration of the fanfolder is accomplished.

While the unit of the referenced patent was exceptionally useful in registering the folder to the traveling web, its design with the motor and worm drive mounted inboard of the frame was found to be undesirable for other applications such as the printing, punching, die cutting, and perforating applications.

Thus, it is a primary object of the present invention to provide registration units which overcome this disadvantage and where the motor and worm drive assembly is mounted outboard of the frame for greater accessibility and proper interface.

In one aspect of the invention a sleeve is rotatably mounted about a shaft outboard of the frame between which the shafts or cylinders to be registered are mounted. Affixed to the sleeve or as part of the sleeve is an output gear and an output drive gear, also located outboard of the frame. The motor and worm gear assembly is mounted on the shaft outboard of the sleeve and engages the output drive gear such that actuation of the motor produces rotation of the sleeve, output drive gear and output gear relative to the shaft. This arrangement is particularly useful for the printing, punching, and perforating operations.

In another aspect of the invention, the sleeve extends through the frame for rotation therein and the output gear is mounted inboard of the frame. This arrangement has been found particularly useful in the die cutting operation and allows use of a symmetrical die which can be changed end to end for longer life.

Thus, it is the primary purpose of this invention to provide an improved registration unit of the type disclosed in the referenced patent particularly suited for use with printing, die cutting, punching, and perforating operations, and where the motor and drive unit is mounted outboad of the frame. These and other objects of the invention will become apparent from the drawing and detailed description to follow.

DETAILED DESCRIPTION OF PREFERRED EMBODIMENTS

Figure 1:
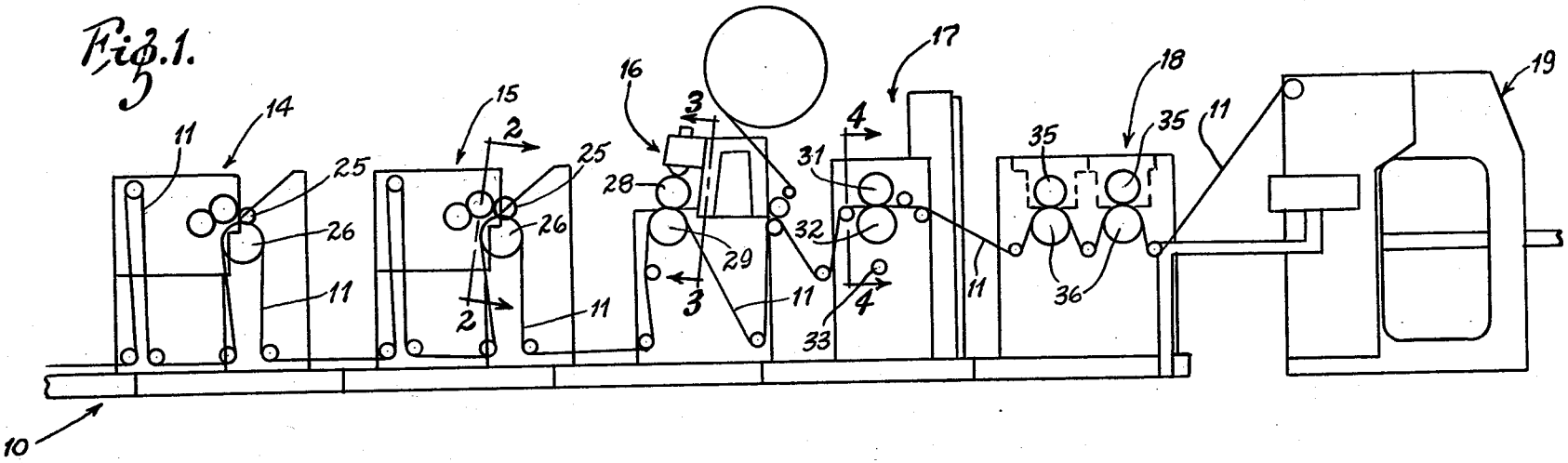
FIG. 1 is a schematic side elevation drawing of a printing press illustrating examples of the various operations for which the registration unit of this invention is used.

Referring to FIG. 1 of the drawing, there is shown an example of the type of apparatus with which the registration unit of this invention is used. Thus, there is shown a printing press 10 for performing various operations on a moving paper web 11, the movement of the web being from left to right as viewed in FIG. 1. Typically, such a web is fed from an unwind unit (not shown) containing a large roll of paper, through one or more printing stations 14 and 15, through a die cutting station 16, a punch station 17, a perforation station 18, and to a folder 19 where the web is folded for further handling. Each of these operations is well known in the art of producing business forms, labels, and the like.

At each of the stations 14 through 19 it is necessary that the operation performed by that station be registered with the web or with the other operations so that each operation is performed on the web at precisely the proper instant of time. Since each of these operations is performed by cooperating cylinders or rollers, the necessary registration can be accomplished by an adjustment of the phase relationship or angular displacement of one roller relative to the other. Thus, at each of the printing stations 14 and 15 there is a print or plate cylinder 25 and an impression cylinder 26, the registration being accomplished by changing the phase of the plate cylinder relative to the impression cylinder. At the die cutting station 16 there is a die cylinder 28 and an anvil cylinder 29, the registration being accomplished by adjusting the phase of the die cylinder relative to the impression cylinder. At the punch station 17 there are male and female punch members 31 and 32 and a drive shaft 33, registration being accomplished by adjusting the phase of the punch members 31 and 32 relative to the drive shaft 33. And at the perforation station 18 there are perforator cylinders 35 and anvil cylinders 36, registration being accomplished by adjusting the phase of the cylinder 35 relative to the cylinder 36.

Figure 4:
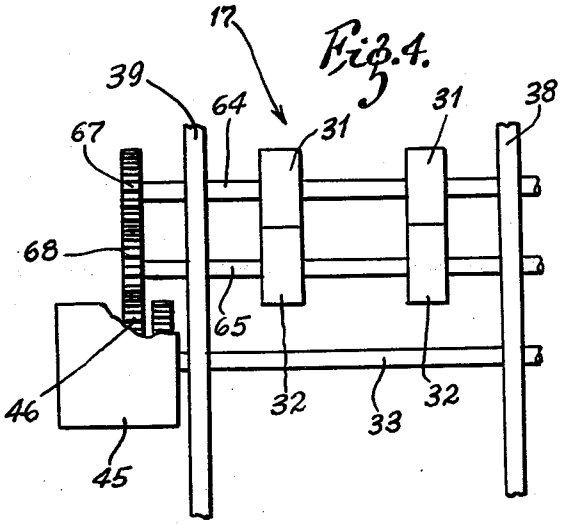
FIG. 4 is a schematic drawing viewed generally along the line 4—4 of FIG. 1.
Figure 3:
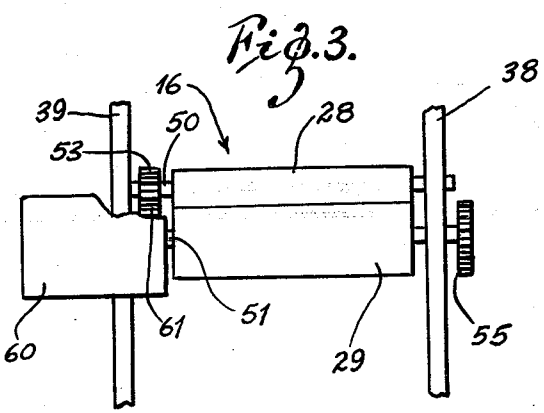
FIG. 3 is a schematic drawing viewed generally along the line 3—3 of FIG. 1.
Figure 2:
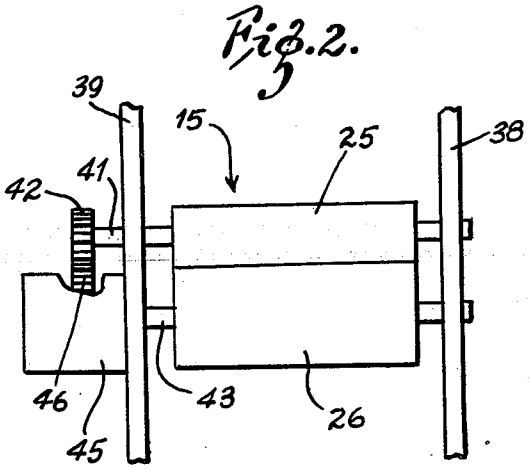
FIG. 2 is a schematic drawing view generally along the line 2—2 of FIG. 1.

The schematics of FIGS. 2 through 4 illustrate generally how the registration unit of this invention cooperates with the cylinders of the respective stations to accomplish proper registration. In FIG. 2 there is shown schematically the print station with the cylinders 25 and 26 rotatably mounted between parallel side frame members 38 and 39 of the printing press 10. The plate cylinder 25 has a shaft 41 extending through the frame member 39 with a gear 42 mounted to the shaft 41 outside or outboard of the frame members. The cylinder 26 has a shaft 43 which is connected to a registration unit 45 of this invention to be more fully described which unit has an output gear 46 which engages the gear 42 for rotatably driving the cylinder 25.

In FIG. 3 there are shown the cylinders 28 and 29 of the die cutting station mounted about shafts 50 and 51, respectively. The shaft 50 is rotatably mounted to the frame members 38 and 39 and has a gear 53 just inboard of the frame member 39. One end of the shaft 51 extends through the frame member 38 and has a gear 55 mounted outboard of the frame member 38. The other end of the shaft 51 extends into a registration unit 60 of this invention to be more fully described which includes an output gear 61 which engages the gear 53 for driving the cylinder 28.

FIG. 4 illustrates the punch station which utilizes the registration unit 45. The male and female punch members 31 and 32 are mounted about shafts 64 and 65 which in turn are rotatably mounted between the frame members 38 and 39. Gears 67 and 68 are mounted to the shafts 64 and 65, respectively, outboard of the frame member 39. The shaft 33 is also rotatably mounted between the frame members 38 and 39 with the end of the shaft 33 feeding into the registration unit 45 outboard of the frame member 39. The output gear 46 of the unit 45 engages the gear 68 for driving the male and female punch members 31 and 32.

An illustration of the registration unit of this invention with the perforation station is not separately shown since it is the same as for the print station of FIG. 2 except that the plate and impression cylinders 25 and 26 are replaced with the perforator and anvil cylinders 35 and 36. The registration unit 45 and 60 will now be described in more detail with reference to FIGS. 5 through 8.

Figure 6:
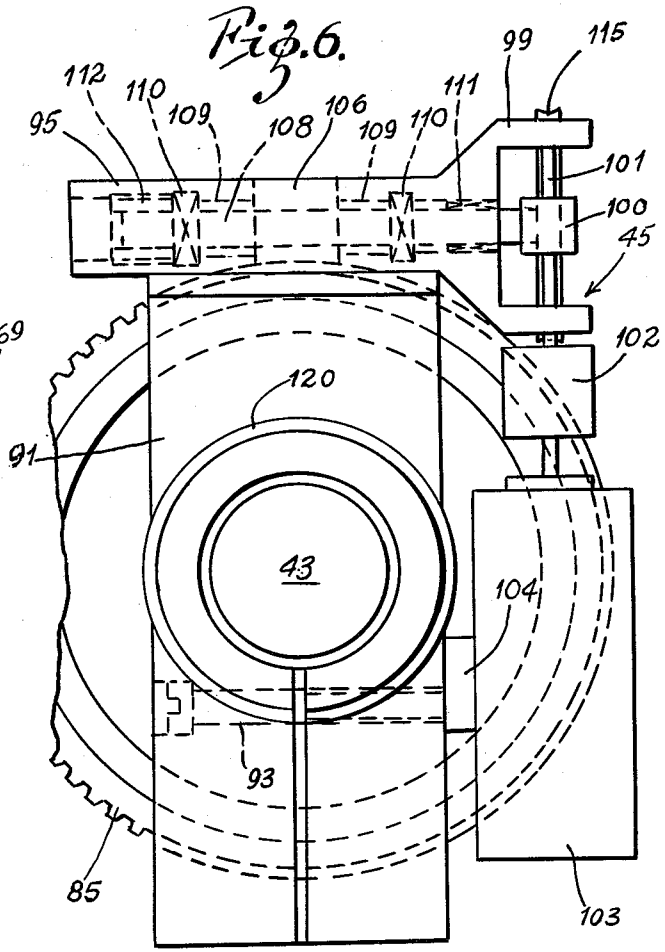
FIG. 6 is a left end view of FIG. 5.
Figure 5:
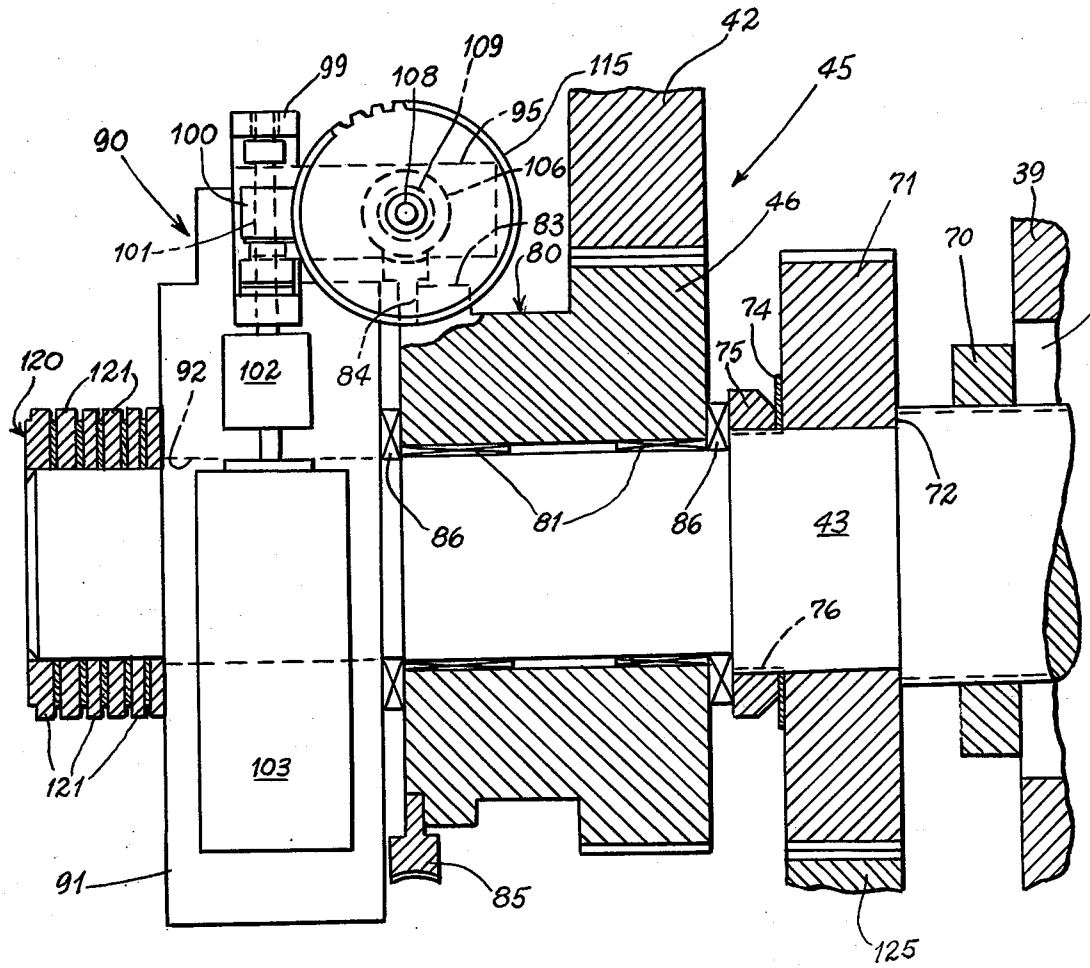
FIG. 5 is a detailed view in partial section of the registration unit portion of FIGS. 2 and 4 as viewed generally the same as in FIGS. 2 and 4.
Figure 7:
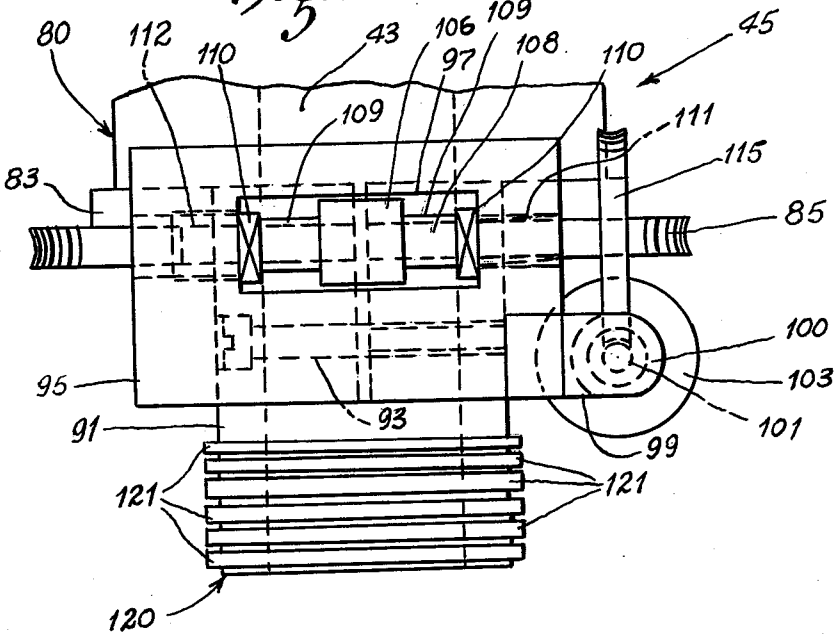
FIG. 7 is a partial plan view of FIG. 6.

In FIGS. 5 through 7 there is shown the registration unit 45 for driving the gear 42 or 68 of the print or perforation cylinders. The shaft 43 or 33 is rotatably mounted within the frame member 39 such as by suitable bearings 69. A nut 70 threadedly engages the shaft 43 just outwardly from the frame member 39 to load the bearings 69, and a concentric gear 71 is mounted just outwardly of the nut 70 against a shoulder 72 of the shaft 43. A concentric gear 71 is held in position such as by a suitable keyway (not shown) and a washer 74 and nut 75 secured on a threaded portion 76 of the shaft 43.

A sleeve 80 is rotatably mounted on the shaft 43 outwardly of the gear 71 by suitable bearings 81. The inner portion of the sleeve 80 is formed in the concentric gear 46 which engages the gear 42 or 68 to drive the plate cylinder 25, punch members 31 and 32, or perforation cylinder 35 in a manner to be further described. The outer end of the sleeve 80 is formed in an annular shoulder 83 and annular notch 84 in which is secured a concentric worm or output drive gear 85. At each end of the sleeve 80 are suitable bushings 86.

Secured to the shaft 43 for rotation therewith outwardly of the sleeve 80, is a motor drive and worm gear assembly 90. The assembly 90 includes a split clamp 91 having an aperture 92 therethrough into which the end of the shaft 43 extends, the clamp 91 being securely fastened to the shaft by a suitable bolt 93 extending through the clamp at its split end as best shown in FIG. 6. A cast frame 95 is mounted at the top of the clamp 91 as depicted in the drawing by any suitable means such as bolts (not shown). The frame 95 is preferably of cast, one-piece construction and has a generally rectangular opening 97 located directly above the worm gear 85, and an ear portion 99 at an outer corner of the frame formed in a yoke. A worm 100 is mounted within the yoke 99 on a shaft 101 for rotation about a generally vertical axis. The shaft 101 is driven through a suitable coupling 102 by an electric motor 103 mounted by a suitable bracket 104 to the clamp 91.

Another worm 106 is mounted within the opening 97 to drivingly engage the worm gear 85. The worm 106 is mounted by a shaft 108, sleeves 109, bushings 110, bearings 111, and a threaded sleeve 112 shown for purposes of illustration. The threaded sleeve 112 is adjusted to load the bushings and prevent the worm 106 from moving along its axis. Other suitable means for mounting the worm 106 within the opening 97 could be used. Another worm gear 115 is secured to the end of the worm shaft 108 for rotation therewith, which gear 115 is in engagement with and driven by the worm 100.

To supply electrical power to the motor 103, a slip ring assembly 120 is secured to the outer end of the shaft 43 and includes conductive rings 121 which receive electrical power from suitable brushes (not shown), and feed that power to the motor 103 by suitable conductors (not shown) for selective actuation of the electric motor either while the shaft 43 is stationary or rotating. The gear 71 is the shaft drive gear which in turn is driven by an external drive source such as a gear 125.

Operation of the Registration Unit 45

The purpose of the unit 45 is to drive the gear 42 or 68 to thus drive the cylinder 25 of the print station, or punch members 31 and 32 of the punch station, or perforation cylinder 35 of the perforation station, through the shaft 43 or 33, while also allowing a phase shift for annular displacement of the gear 42 or 68 relative to the shaft 43 or 33.

Under normal operating conditions, i.e., when the printing press 10 is operating to produce forms, labels, or the like, the gear 125 drives the gear 71 which in turn drives the shaft 43 and motor and worm gear assembly 90. Since the assembly 90 is in engagement with the sleeve 80 through the worms 100 and 106 and the worm gears 115 and 85, rotation of the shaft 43 also imparts rotation to the sleeve 80 all about the rotating axis of the shaft 43. With rotation of the gear portion 46 of the sleeve 80, the gear 42 or 68 is driven so as to drive the appropriate one of the cylinders 25, 31 and 32, or 35.

Phase adjustment or registration is accomplished by selectively actuating the electric motor 103 through suitable controls energizing the slip ring assembly 120. Energizing the motor 103 drives the worm 100 which in turn drives the worm gear 115 and the worm 106, and which through engagement with the worm gear 85 drives the sleeve 80 and gear portion 46 relative to the shaft 43. The motor and worm gear assembly 90 constitutes a double gear reduction which provides a very fine angular adjustment of the sleeve 80. The motor 103 is preferably a DC motor which can be actuated to operate in either the forward or reverse direction for angular adjustment of the sleeve 80 in either direction. The angular adjustment or registration can be accomplished while the shaft 43 is rotating as during normal operation of the machine. The arrangement of the sleeve 80 and motor and worm gear assembly 90, as well as the gear 71 outboard of the frame member 39, makes the registration unit 45 uniquely suitable for use with the printing station 14 or 15, the punch station 17, and the perforator station 18.

Figure 8:
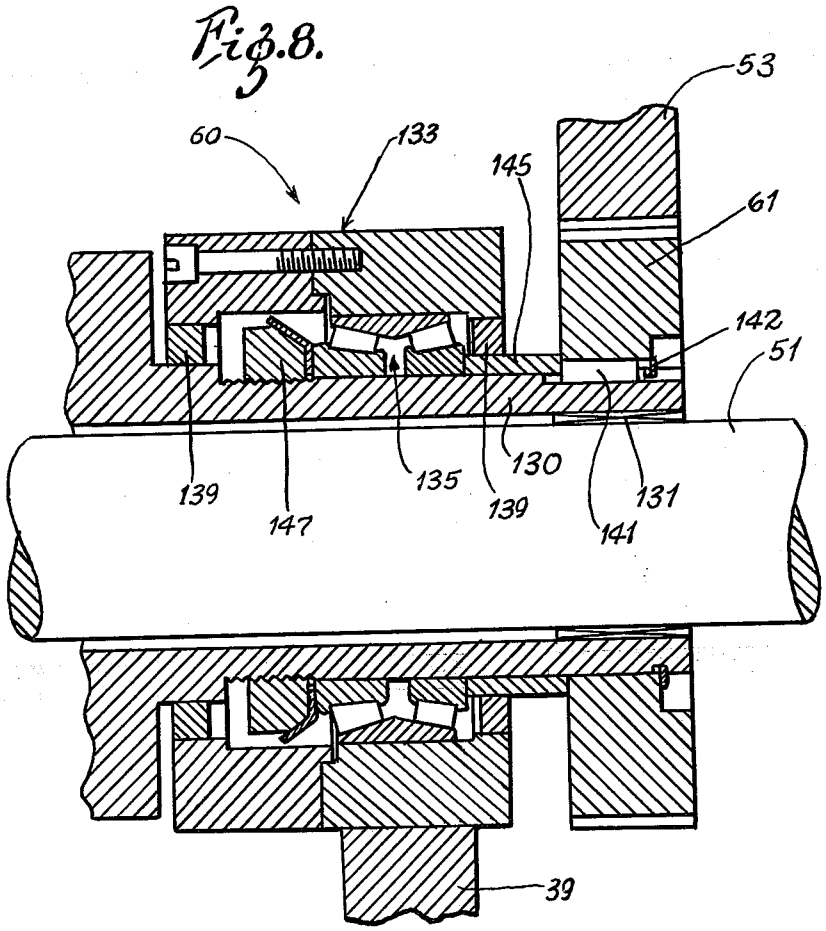
FIG. 8 is a partial sectional view similar to FIG. 5 but of the registration unit of FIG. 3.

In FIG. 8 there is shown the registration unit 60 for use with the die cutting station. The shaft 51 of the mandrel 29 is rotatably mounted within a sleeve 130 with suitable bearings 131, the sleeve 130 in turn being rotatably mounted within a split bearing retainer 133 by means of a bearing 135 between the retainer 133 and sleeve 130. The bearing retainer 133 surrounds the bearing 135 and is held together by bolts 137. Seals 139 are located at each end of the retainer 133 and the retainer is securely mounted to the frame member 39.

The output gear 61 is fixed to the sleeve 130 for rotation therewith inboard of the frame member 39 by means of a key and keyway 141 and a snap ring 142. A spacer sleeve 145 surrounds the sleeve 130 between the gear 61 and the bearing 135, and a nut and lock washer assembly 147 threadedly engages the sleeve 130 at the other side of the bearing 135. Thus, the bearing 135 is loaded by means of the nut and lock washer assembly 147 acting on one side and the snap ring 142 retaining the other side through the gear 61 and spacer sleeve 145. The gear 61 engages the gear 53 for driving the die cylinder 28.

Mounted to the outboard end of the shaft 51 and sleeve 130 is the motor drive and worm gear assembly 90 which is generally that part of FIG. 5 shown by the line 7—7. The gear 55 located outboard of the frame member 38 is the drive gear for the shaft 51.

Operation of the Unit of FIG. 8

Under normal operating conditions the shaft 51 drives the sleeve 130 and inboard gears 61 and 53 through the motor drive and worm gear assembly 90. The phase of the cylinder 28 relative to the cylinder 29 may be adjusted by actuation of the electric motor 103 which produces rotation of the sleeve 130 within the retainer 133 and relative to the shaft 51, thereby driving the gear 53 and die cylinder 28 relative to the cylinder 29.

Thus, there has been described novel registration units for use with printing, die cutting, punching, and perforating stations of a printing press or the like where a motor drive and worm gear assembly is mounted outboard of the frame and cooperates with a rotatably mounted sleeve to allow phase or angular displacement adjustment of one cylinder relative to the other.

Various changes and modifications may be made in this invention, as will be readily apparent to those skilled in the art. Such changes and modifications are within the scope and teaching of this invention as defined by the claims appended hereto.

What is claimed is:

1. In an apparatus for performing operations on a continuous paper web, a registration unit for changing the phase of a first shaft relative to a second shaft, said shafts rotatably mounted between parallel frame members, said registration unit comprising a sleeve rotatably mounted about said second shaft and having an output gear mounted thereto and rotatably therewith, said gear being concentric with said second shaft, an output drive gear mounted to said sleeve and concentric with said second shaft for rotation with said sleeve, means responsive to rotation of said output gear for drivingly rotating said first shaft, means rotatably driving said second shaft, and means mounted to said second shaft for rotation therewith outboard of said sleeve and frame members and at the same side of said frame as said sleeve and engaging said output drive gear for selectively rotating said output drive gear relative to said second shaft, said means mounted to said shaft and engaging said output drive gear further comprising a split collar secured to said second shaft for rotation therewith outboard of said sleeve, an electric motor secured to said collar for rotation therewith and said second shaft, slip ring means concentric and rotatable with said second shaft for supplying electrical power to energize said motor, gear drive means for driving said output drive gear relative to said second shaft in response to rotation of said motor shaft, and means for selectively energizing said motor for selective rotational displacement of said output drive gear, sleeve, output gear and first shaft relative to said second shaft.

2. The registration unit of claim 1 wherein said output gear is mounted to said sleeve outboard of said frame members.

3. The registration unit of claim 1 further comprising a double reduction gear means between said motor shaft and said output drive gear.

4. The registration unit of claim 3 further comprising a first worm mounted to said motor shaft for rotation therewith, a worm gear driven by said first worm, a second worm concentric with said worm gear and rotatable therewith, said second worm engaging said output drive gear.

5. The registration unit of claim 4 further comprising a bracket mounted for rotation with said second shaft, said bracket having an opening and yoke formed therein, said first worm rotatably mounted in said yoke concentric with said motor shaft, and said second worm rotatably mounted in said opening about an axis normal to the rotational axis of said first worm.

6. The registration unit of claim 1 wherein said means for driving said second shaft further comprises a gear mounted for rotation with said second shaft between said output gear and the nearest one of said frame member.

7. The registration unit of claim 6 wherein said first shaft is that of a print cylinder and said second shaft is that of an impression cylinder.

8. The registration unit of claim 6 wherein said first shaft is that of a punch member having male and female members, and said second shaft is a drive shaft.

9. The registration unit of claim 6 wherein said first and second shafts are those of the perforator and anvil cylinders of a perforation station.

10. In an apparatus for performing operations on a continuous paper web, a registration unit for changing the phase of a first shaft relative to a second shaft, said shafts rotatably mounted between parallel frame members, said registration unit comprising a sleeve rotatably mounted about said shaft and extending through one of said frame members, said sleeve having an output gear mounted thereto on one side of said one frame member for rotation with said sleeve and an output drive gear mounted thereto on the other side of said one frame member for rotation with said sleeve, said output gear and output drive gear being concentric with said second shaft, means responsive to rotation of said output gear for drivingly rotating said first shaft, means for drivingly rotating said second shaft, and means mounted to said second shaft for rotation therewith and at the same side of said frame where said sleeve is mounted and engaging said output drive gear for selectively rotating said output drive gear relative to said second shaft, whereby rotation of said output drive gear relative to said second shaft produces rotation of said sleeve, output gear, and first shaft relative to said second shaft.

11. The registration unit of claim 10 wherein said means mounted to said second shaft for selective rotation of said output drive gear is mounted outboard of said sleeve and frame members.

12. The registration unit of claim 11 wherein said output gear is inboard and said output drive gear is outboard of said frame.

13. The registration unit of claim 12 wherein said means for driving said second shaft further comprises a gear mounted for rotation with said second shaft outboard of said frame at the side of said frame opposite where said sleeve is mounted.

14. The registration unit of claim 12 wherein said first shaft is that of a die cylinder, and said second shaft is that of an anvil cylinder.

15. The registration unit of claim 12 wherein said means mounted to said shaft and engaging said output drive gear further comprises an electric motor, means for mounting said motor to said second shaft for rotation therewith, slip ring means concentric and rotatable with said second shaft for supplying electrical power to energize said motor, gear drive means for driving said output drive gear relative to said second shaft in response to rotation of said motor shaft, and means for selectively energizing said motor for selective rotational displacement of said output drive gear, sleeve, output gear and first shaft relative to said second shaft.

16. The registration unit of claim 15 further comprising a double reduction gear means between said motor shaft and said output drive gear.

17. The registration unit of claim 16 further comprising a first worm mounted to said motor shaft for rotation therewith, a worm gear driven by said first worm, a second worm concentric with said worm gear and rotatable therewith, said second worm engaging said output drive gear.

18. The registration unit of claim 17 wherein said motor is mounted to a split collar secured to said second shaft outboard of said sleeve.

19. The registration unit of claim 17 further comprising a bracket mounted for rotation with said second shaft, said bracket having an opening and yoke formed therein, said first worm rotatably mounted in said yoke concentric with said motor shaft, and said second worm rotatably mounted in said opening about in axis normal to the rotational axis of said first worm.

* * * * *